United States Patent [19]

Farrar et al.

[11] Patent Number: 4,686,513

[45] Date of Patent: Aug. 11, 1987

[54] ELECTRONIC SURVEILLANCE USING SELF-POWERED ARTICLE ATTACHED TAGS

[75] Inventors: James G. Farrar, Boca Raton; Ezra D. Eskandry, Miami, both of Fla.

[73] Assignee: Sensormatic Electronics Corporation, Deerfield Beach, Fla.

[21] Appl. No.: 781,537

[22] Filed: Sep. 30, 1985

[51] Int. Cl.[4] ..... G08B 13/18

[52] U.S. Cl. ..... 340/572; 340/571

[58] Field of Search ..... 340/572, 568, 571

[56] References Cited

U.S. PATENT DOCUMENTS

| | | | |
|---|---|---|---|
| 3,713,133 | 1/1973 | Nathans | 340/572 |
| 4,511,888 | 4/1985 | Bernhardt | 340/568 |
| 4,559,529 | 12/1985 | Bernhardt | 340/568 |
| 4,573,042 | 2/1986 | Boyd et al. | 340/568 |

*Primary Examiner*—Glen R. Swann, III

*Attorney, Agent, or Firm*—Robin Blecker & Daley

[57] ABSTRACT

Alarm tags releasably attachable to articles to be monitored in a retail installation or the like have enhanced operational capabilities giving rise to an improved likelihood of detection of article theft. The system has a transmitter unit which radiates signals containing diverse message contents. The tags each include an attachment device for releasably securing the tag to an article, a receiver unit for receiving such radiated signals and decoding the messages therein, an alarm unit and a signal processor, the latter being responsive to the state of the attachment device and to decoded messages for selectively operating the alarm unit to provide sensible output alarm indication.

In a preferred embodiment, the system includes a transmitter in an exit area of the retail installation which radiates a signal containing a first message for receipt only by tags in such area and has a transmitter in a checkout area which radiates signals containing various selectable messages for article checkout purposes.

20 Claims, 18 Drawing Figures

ELECTRONIC SURVEILLANCE USING SELF-POWERED ARTICLE ATTACHED TAGS

FIELD OF THE INVENTION

The invention relates generally to anti-pilferage and pertains more particularly to electronic article surveillance of type involving communication between receptor receiver devices attached to articles and surveillance control apparatus.

BACKGROUND OF THE INVENTION

Methods and systems for the purpose at hand which have seen primary commercialization are of type involving passive article- attached devices, i.e., of type not including power sources. Such devices have, in prior patents, been termed receptor-reradiators and are adapted to reradiate or retransmit energy incident thereon in preselected relation thereto. By way of example, article tags have included radiator-receptor devices having an antenna, for receiving microwave and modulated low-frequency energy transmitted into and beyond a surveillance or control area, and a nonlinear element, such as a diode, directly connected to the antenna. The radiator-receptor output energy is thereby a reradiation of the microwave and modulated low-frequency incident energy.

As is well known, radiation pattern control, in relatively small areas, such as retail establishments, libraries, etc., is difficult in proportion to increase in the frequency level. The microwave energy is quite difficult to control in pattern. Thus, the industry has looked to the microwave as a carrier and to a lower, more pattern controllable, transmitted frequency radiated also into the area under coverage with a modulation characteristic, and to establishing alarm conditions based upon joint receipt and reradiation of the two diverse frequency incident energies. Alarm condition is sensed upon detection of the modulation characteristic of the low-frequency reradiated signal.

Despite the refined detection capability of the multiple frequency systems, and the pattern control aspect of the low-frequency transmission in the described system, a degree of ambiguity can still attend same, based on the variation from intended pattern of the relatively controllable low-frequency transmission. The desired, well-defined line of demarcation as between the surveillance zone and adjacent article display zones is at times not attained and this gives rise, on occasion, to incorrect alarm indication in intended display areas and corresponding diminution of the usable display area.

Plural low-frequency modulated signals have been considered, and a quite recent development has looked to the selective de-sensitizing of a receiver as respects signals reradiated from the article display area by use of unmodulated auxiliary low-frequency transmissions, for defining the demarcation line and enhancing display area usage.

Based on the possible ambiguities in the foregoing practices and systems, the industry continues to look to alternative approaches to the above, including use of independently-powered article affixed devices having safety-pins or like mechanically responsive alarming apparatus, as in commonly-assigned Nathans U.S. Pat. No. 3,713,133, issued on Jan. 23, 1973 and U.S. patent application, Ser. No. 474,966, filed on Mar. 4, 1983 in the names of Robert C. Boyd and Charles L. LaPatra, entitled "Electronic Article Surveillance Security System." In the system of the '966 application, the article-attachable tag unit (alarm device) has a switch, which isooperated upon efforts to remove the tag unit from the article, and an audible tone generator which is activated upon such switch operation. Further, the tag unit has a receiving antenna and a related received frequency detector, which will also operate the alarm device. A transmitter radiates energy at the receiver detectable frequency into a control area for surveillance thereof.

While the system and device of the '966 application are thought to be viable as an alternative to the systems previously above discussed, in providing powered circuitry at the tag itself both for discernment of a specific frequency and of removal of the tag to generate an alarm localized to the immediate tag location, such system and device are in rudimentary character in the '966 application. For instance, the alarm device is disarmable only upon mechanical interfitting thereof with a "negator", typically fixedly located, e.g., at a checkout location. Further, such system contemplates only unidirectional transmission, i.e., to the tag alarm device. In brief, capabilities of usage of the '966 system are limited by reason of the simplistic character of the device therein.

SUMMARY OF THE INVENTION

The present invention has its primary object the provision of improved system, method and apparatus for electronic article surveillance.

It is a more particular object of the invention to provide expanded operational capabilities in electronic article surveillance systems of type employing self-powered tags with alarm capability.

In attaining the foregoing and other objects, the invention provides an electronic article surveillance system of type employing alarm tags releasably attachable to articles to be monitored in a retail installation or the like, wherein the tags have enhanced operational capabilities giving rise to an improved likelihood of detection of article theft. To this end, the system has a transmitter unit which radiates signals containing deverse message contents. The tags each include an attachment device for releasably securing the tag to an article, a receiver unit for receiving such radiated signals and decoding the messages therein, an alarm unit and a signal processor, the latter being responsive to the state of the attachment device and to decoded messages for selectively operating the alarm unit to provide sensible output alarm indication.

In a preferred embodiment, the system includes a transmitter in an exit area of the retail installation which radiates a signal containing an exit interrogate for receipt only by tags in such area and has a transmitter in a checkout area which radiates signals containing various selectable interrogate messages for article checkout purposes. Other transmitters may be provided, such as portable units for use by security guards to terminate alarm indications.

Tags assume various states in accordance with received and decoded messages and the state of the attachment devices. Thus, a tag may be in disarmed state, ready state, armed state, theft state and slip state, as is explained in detail below. Further, each tag is adapted to communicate messages to a central monitoring station and local monitoring devices, such as may be placed in fitting rooms, receive tag transmissions and communicate such condition to the central station.

Sensing units may be provided to respond to the tag output alarm indication to generate supplemental local alarm indication.

In a further aspect, tags have capability for issuing different types of output alarm indication to signify different tag experiences.

Further, the system may include a secondary transmitter at the exit and checkout areas to effect highly localized and defined ranges in which the primary transmitter signals will be decodable to convey intelligence.

The foregoing and other features of the invention will be further understood from the following detailed description of preferred embodiments and practices thereof and from the drawings, wherein like reference numerals identify like parts and components throughout.

DESCRIPTION OF PREFERRED EMBODIMENTS AND PRACTICES.

Figure 1:
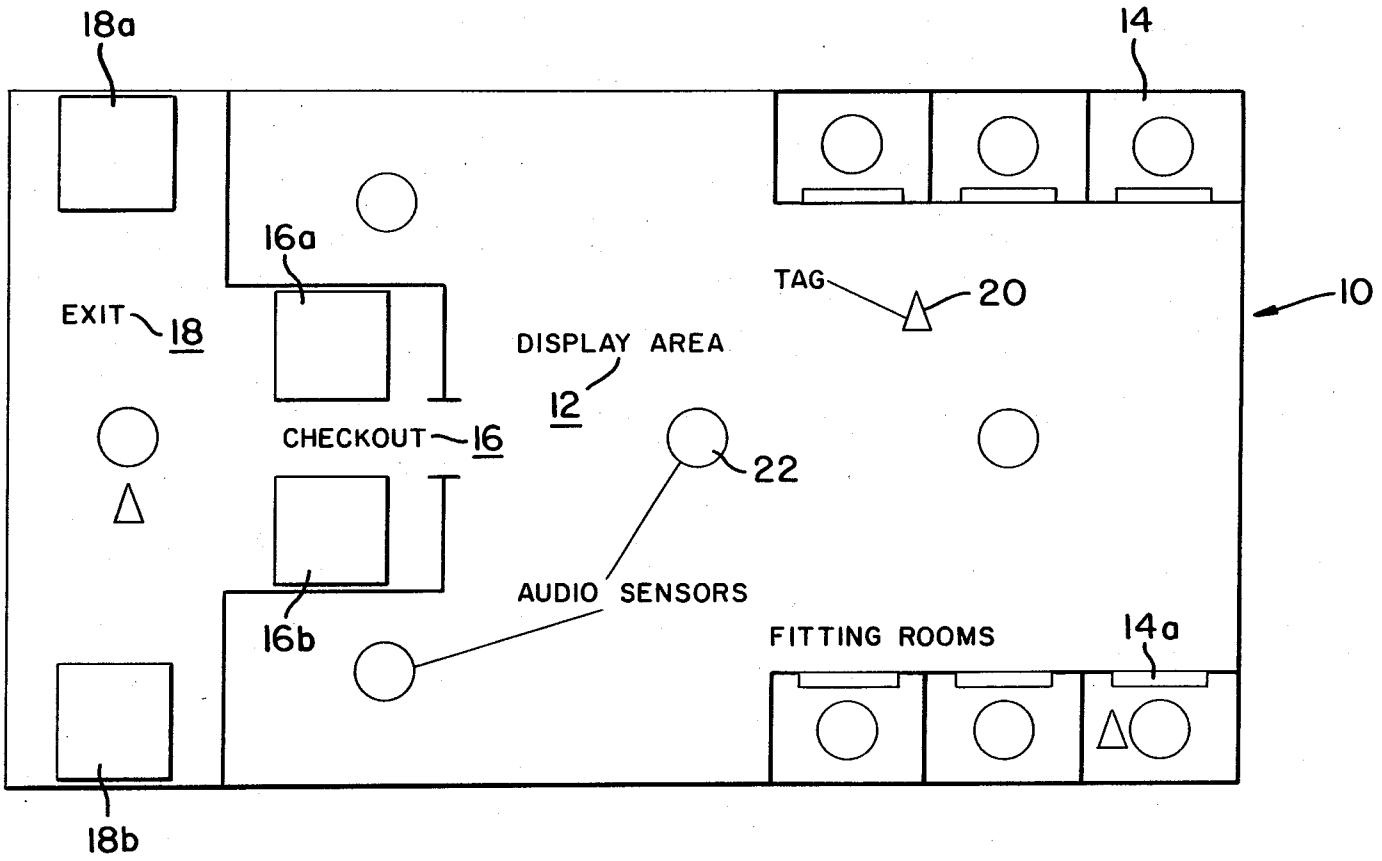
FIG. 1 is an illustration of a typical installation of a surveillance system in accordance with the invention.

Referring to FIG. 1, installation 10 is a retail establishment including a display area 12 having fitting rooms 14 to its sides with fitting units 14*a*, a checkout station 16 having cashier and wrapping desks and associated transmitter units 16*a* and 16*b* and an exit area 18 having transmitter and receiver units 18*a* and 18*b*. Tags are indicated by triangles at 20 and audio sensing devices are noted at various locations by the circles 22. Where tags 20 have transmit capability, as is preferred, the various transmitters will be configured as transceivers, having both transmit and receive function.

Figure 2:
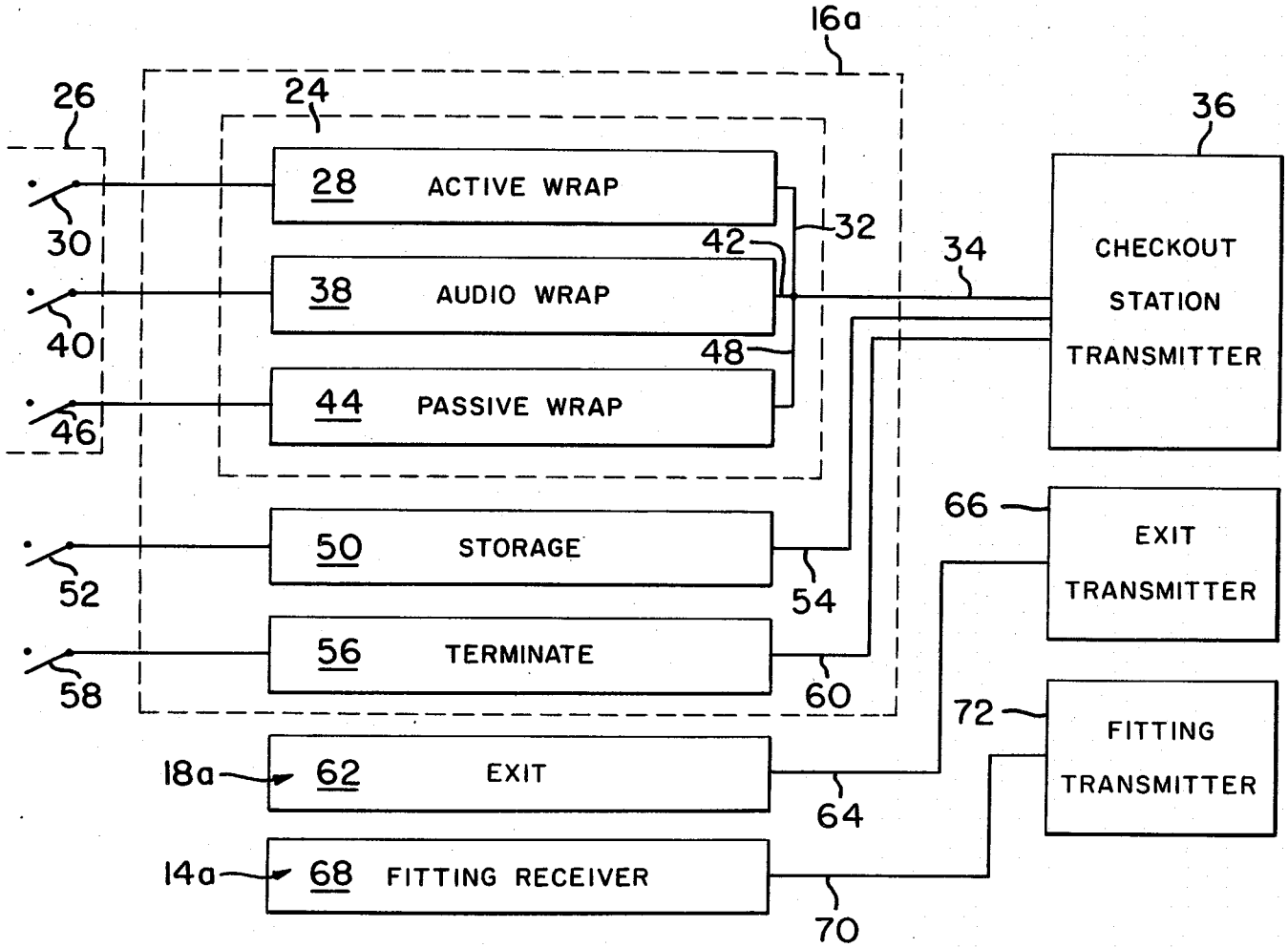

Checkout station transmitter unit 16*a* is shown particularly in FIG. 2 as including wrap message generator 24 and wrap message selector 26. The system of the invention contemplates three different checkout modes, Active Wrap, Audio Wrap and Passive Wrap, which will be understood from discussion below in connection with the checkout flow chart of FIGS. 7(*a*)–(*c*). Where Active Wrap is selected, generator 28 is operable by closure of switch 30 of selector 26. The output of generator 28 is conveyed over lines 32 and 34 to checkout station transmitter 36.

Where Audio Wrap is selected, generator 38 is operable by closure of switch 40 of selector 26 and output is furnished over lines 42 and 34 to transmitter 36. Likewise, where Passive Wrap is selected, generator 44 is operable by closure of switch 46 of selector 26 and output to transmitter 36 is over lines 48 and 34.

The checkout station further includes Storage generator 50 operable upon closure of switch 52 to apply a signal over line 54 to transmitter 36, such signal containing the Storage message for placing a tag in storage. Terminate generator 56 is operable by closure of switch 58 to apply a signal containing the Terminate message over line 60 to transmitter 36, such signal being effective to silence an alarming tag.

Exit generator 62 of exit transmitter unit 18*a* is operable at all times for conveying a signal containing the Exit interrogate message over line 64 to exit transmitter 66. Fitting receiver 68 of fitting unit 14*a* is operable upon receiving a tag transmission to energize fitting unit transmitter 72 over line 70, whereby a central or control station may be apprised of an alarm condition in such sequestered area.

Figure 3:
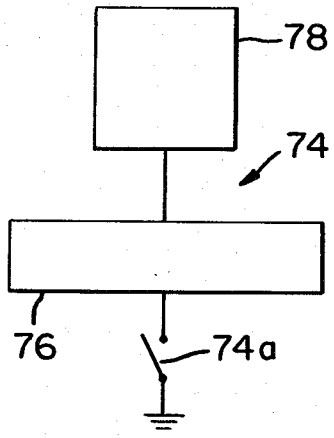
FIGS. 2 and 3 are block diagrams of various transmitters which may be involved in the installation of FIG. 1.

In FIG. 3 is shown portable unit 74. Closure of its switch 74*a* gives rise to generator 76 applying to portable transmitter 78 a signal containing the Terminate message.

Figure 4:
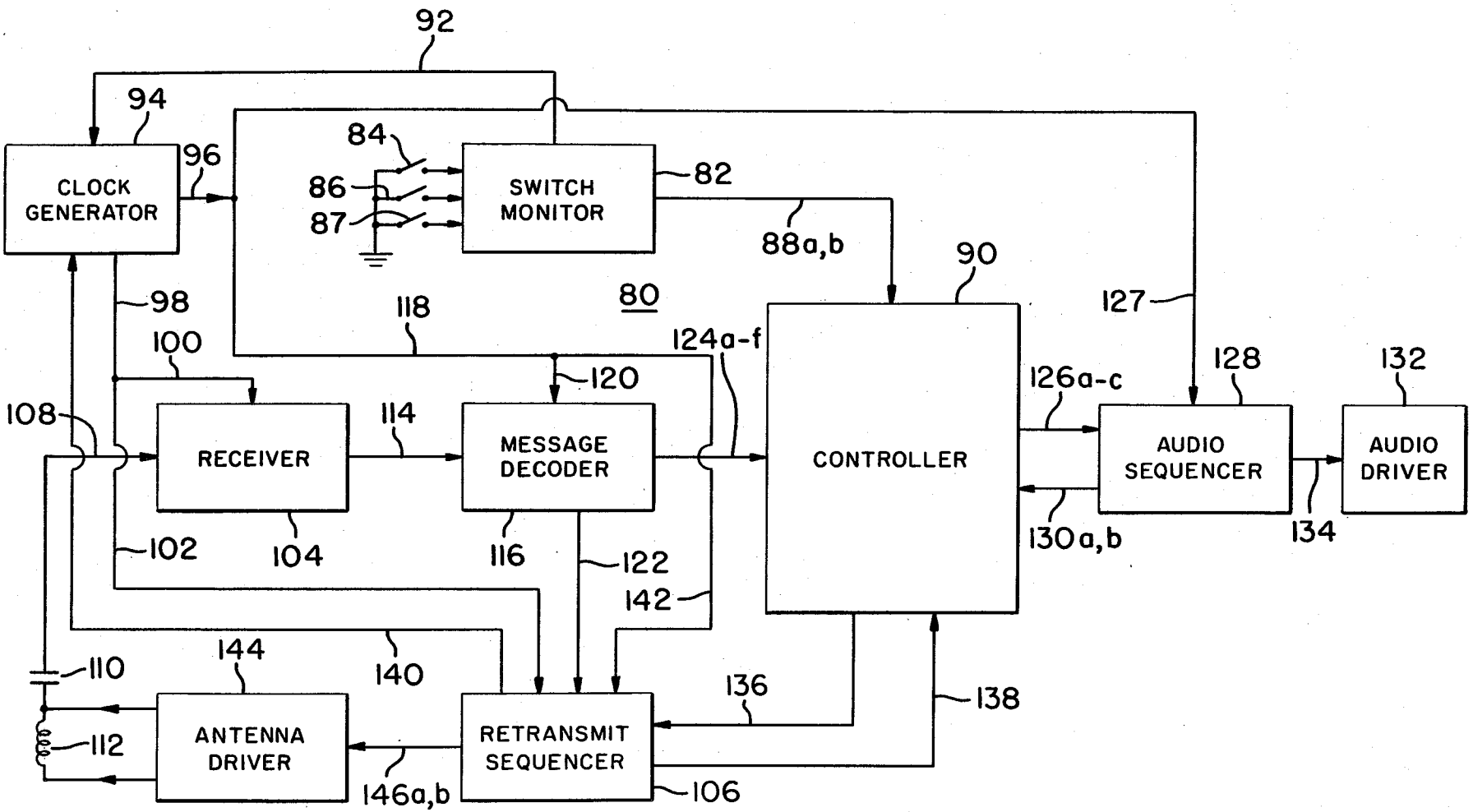
FIG. 4 is a block diagram of a preferred embodiment of a tag system for use in the FIG. 1 installation.

Tag system 80 of FIG. 4 includes switch monitor 82 which looks to the state of a tag attachment device, typically, an attachment pin, represented by switch 84, and to the state of a further switch 86, which changes state upon an attack on the tag, e. g., application of crushing force thereto. Upon change in state of either of switches 84 or 86, monitor indicates same on the corresponding one of lines 88*a* and 88*b* to controller 90. A further switch 87 may be included in the tag which is sensitive to motion of the tag and may also be looked at by monitor 82. Where the motion switch is off, tag battery like may be conserved by interrupting the supply of power to the tag.

Monitor 82 applies a signal to line 92 upon closure of switch 84, i.e., indicative of placement of the tag in active use, to clock pulse generator 94. Such start-up signal is for purposes of conservation of the battery which powers the tag system. On receipt thereof, generator 94 issues clock pulses on line 96 and furnishes wake-up indication over lines 98, 100 and 102 to receiver 104 and retransmit sequencer 106. Receiver 104 is coupled by line 108 and capacitor 110 to tag antenna 112.

The output of receiver 104 is applied over line 114 to message decoder 116, which receives clock pulses over lines 118 and 120. The receiver also outputs indication of received and decoded interrogate messages over line 122 to retransmit sequencer 106. Output lines 124*a* through 124*f* extend from receiver 104 to controller 90 whereby the controller is apprised of received and decoded messages.

Controller 90 applies output control signals over lines 126*a* through 126*c* to audio sequencer 128, which recives clock pulses over line 127 and informs controller 90 of its activity over lines 130*a* and 130*b*. Audio driver 132, which includes a piezoelectric audio output component, is provided with drive signals over line 134 by audio sequencer 128.

Controller 90 furnishes control signals over line 136 to retransmit sequencer 106 and the latter informs controller 90 of its activties over line 138.

Sequencer 106 furnishes a stop signal over line 140 to clock pulse generator 94 and applies output signals governing tag retransmission to antenna driver 144 over lines 146*a* and 146*b*.

Figure 5:
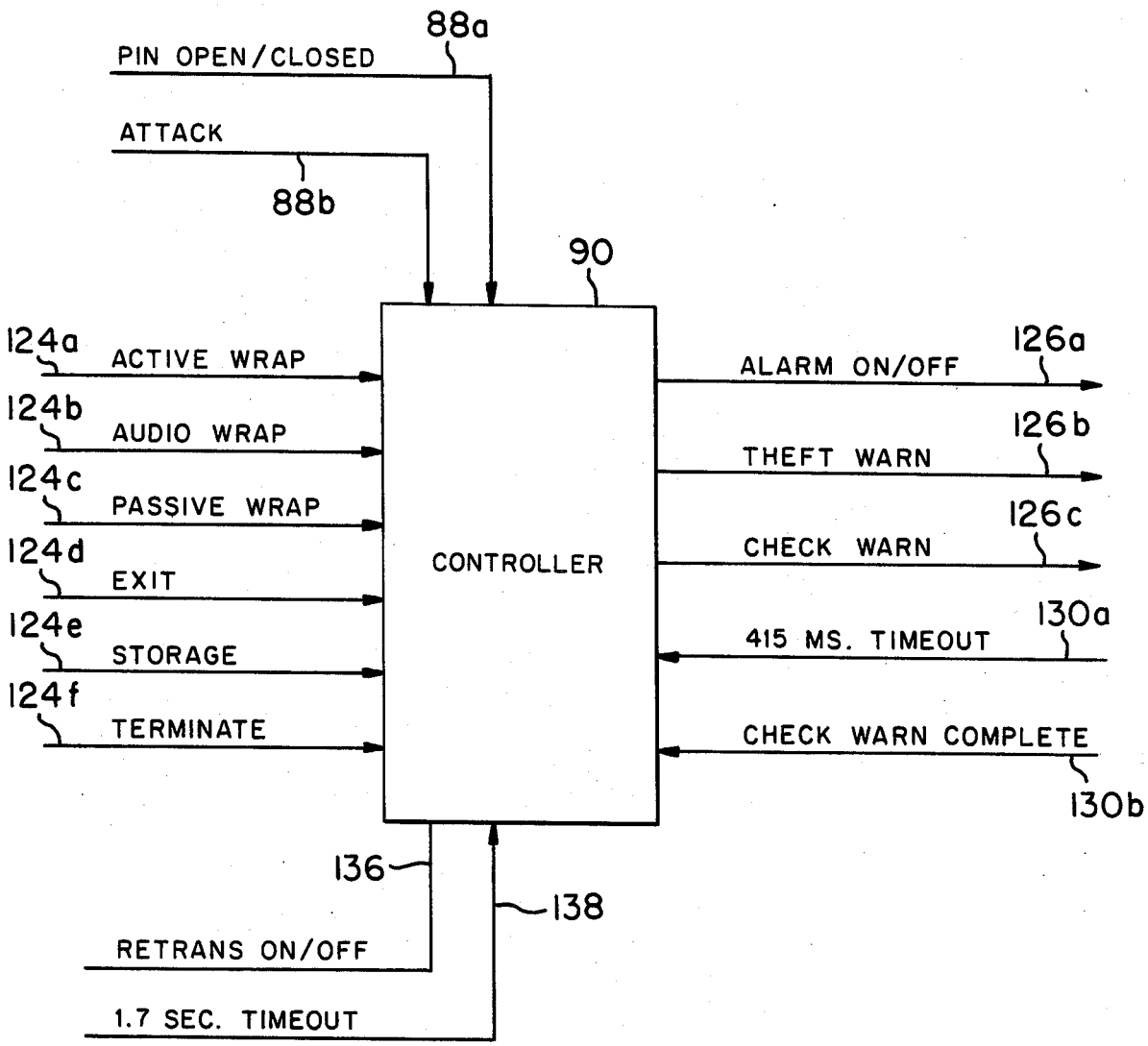
FIG. 5 is a separate showing of the controller of the FIG. 4 tag system with indication of its various input and output signals.

The input and output signals of controller 90 are collected in FIG. 5 with literal indication of the type of signal and its origin line from FIG. 4. The decoded messages, shown at the left input to controller 90 include Active Wrap, Audio Wrap, Passive Wrap, Exit, Storage and Terminate signals. At the top input to controller 90 are shown the Pin Open/Closed and Attack signals. At the right of controller 90 are shown three different signals for audio output, namely, Alarm On/-Off, Theft Warn and Check Warn signals. Below these signals are shown the replies of the audio output circuitry, 415 ms. Timeout and Check Warn Complete. Below controller 90 are shown its output to the retransmit sequencer, the Retrans On/Off signals, and the sequencer input to the controller, the 1.7 sec. Timeout signal.

Implementation of controller 90 will be discussed in connection with the flow charts of FIGS. 6 through 9, from which tag and system experience will also be seen.

Figure 6A:
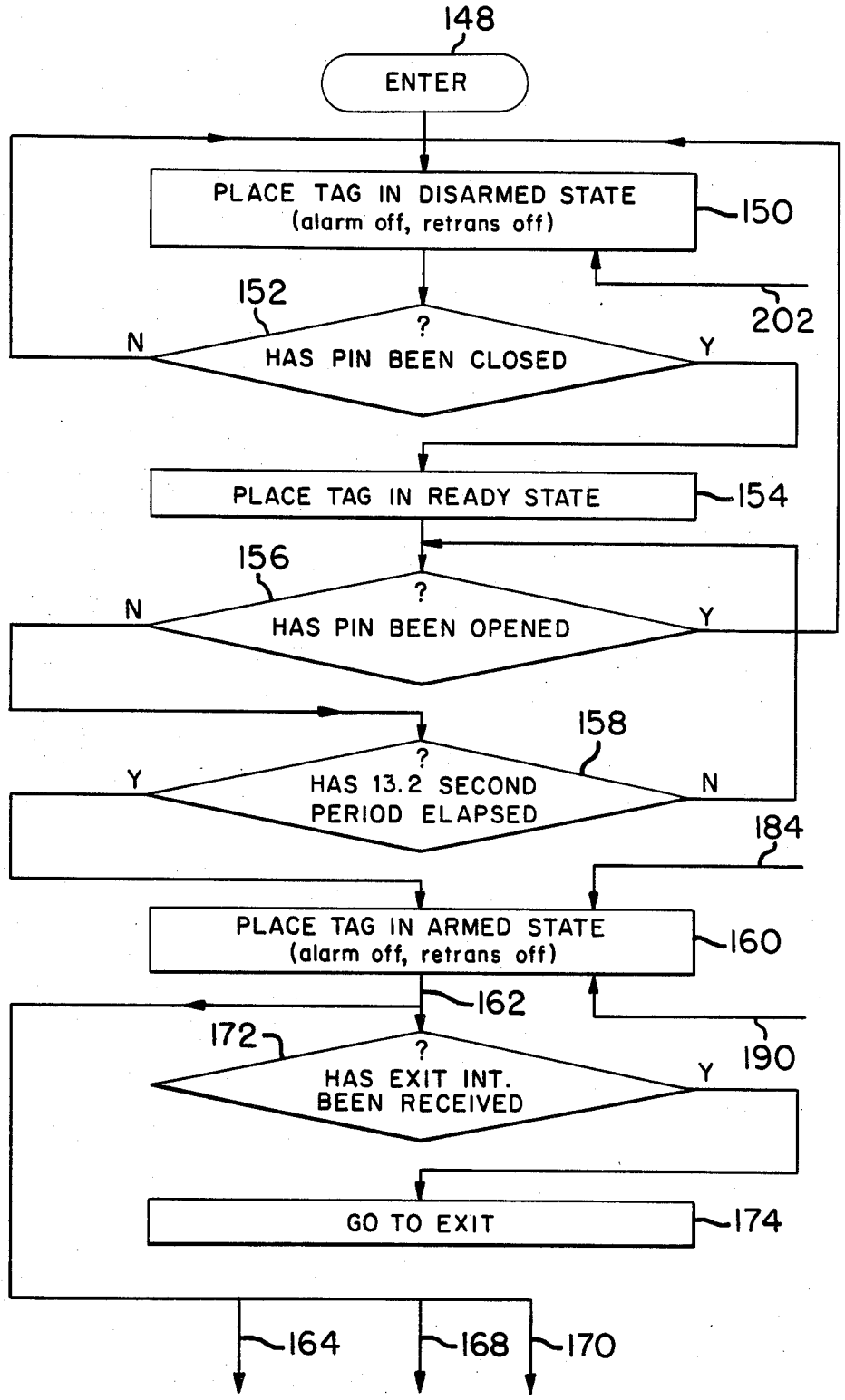
FIGS. 6(*a*) and 6(*b*) depict the flow chart of the main program implemented by the controller of FIG. 5.
Figure 6B:
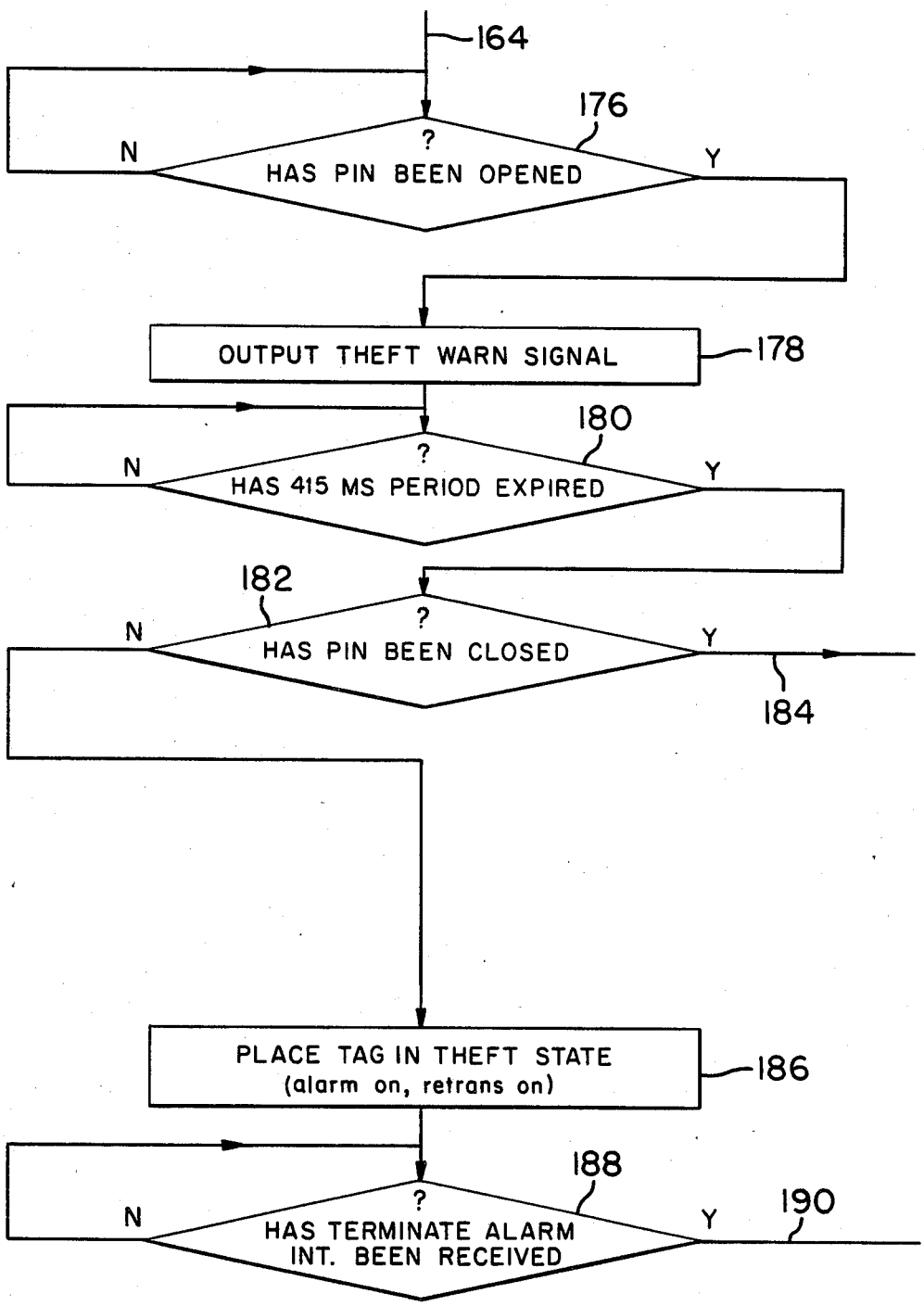

Turning to the main program, same is entered in step 148 (Enter) of FIG. 6(*a*) and starts with the tag in Disarmed state (step 150 - Place Tag in Disarmed State). In this state, the tag alarm is off as is its retransmitter (retrans). Various measures will place the tag in Disarmed state, e.g., the Store message. The inquiry of step 152 - ? Has Pin Been Closed - is repeated on negative (N) answer and otherwise (yes - Y) leads to step 154 - Place Tag in Ready State. The ready state is an interim or transient tag state, commencing with the inquiry of step 156 - ? Has Pin Been Opened. A time period for this inquiry is set by step 158 - ? Has 13.2 Second Period Elapsed. If the pin is opened prior to the end of this period, return is made from step 156 to step 150. Otherwise, on expiration of the period, the program advances to step 160 - Place Tag in Armed State.

In the Armed State, the tag alarm and retransmission are both off. Four paths of inquiry, as indicated by lines 162, 164, 168 and 170, are cycled through at this juncture, the first of which is set out in step 172 - ? Has Exit Int. Been Received. If the exit interrogation (message) is being received by the tag, the program advances through step 174 - Goto Exit - to the exit subroutine of FIG. 8, below discussed.

In the second Armed State inquiry, step 176 is practiced - ? Has Pin Been Opened. If the answer to this inquiry is affirmative, a warning is provided to the consumer in step 178 - Output Theft Warn Signal. A short time period is measured in step 180 - ? Has 415 ms. Period Expired. Four tenths of a second are thus provided to permit the consumer to discontinue further efforts at opening of the pin to remove the tag from the article. If the consumer discontinues the opening course of action, an affirmative answer will result from the inquiry of step 182 - ? Has Pin Been Closed, and line 184 will return the program to Step 160 above.

Should the consumer continue in pin removal, advance is made to step 186 - Place Tag in Theft State. Here, the tag alarm is turned on as is the tag retransmission. This condition will persist until security personnel take the measure of step 188 - ? Has Terminate Alarm Int. Been Received, at which time the program follows line 190 back to step 160 above.

The third path of inquiry through line 168 is to a step (not shown) - ? Has Wrap Int. Been Received. On positive answer to this inquiry, the program advances to its checkout subroutine of FIG. 7, below discussed through step 198 - Goto Checkout.

The fourth path of inquiry through line 170 is to a step (not shown) - ? Has Store Int. Been Received. On positive answer to this inquiry, the program returns via line 202 to step 150, whereby the tag is placed in Disarmed state.

Figure 7A:
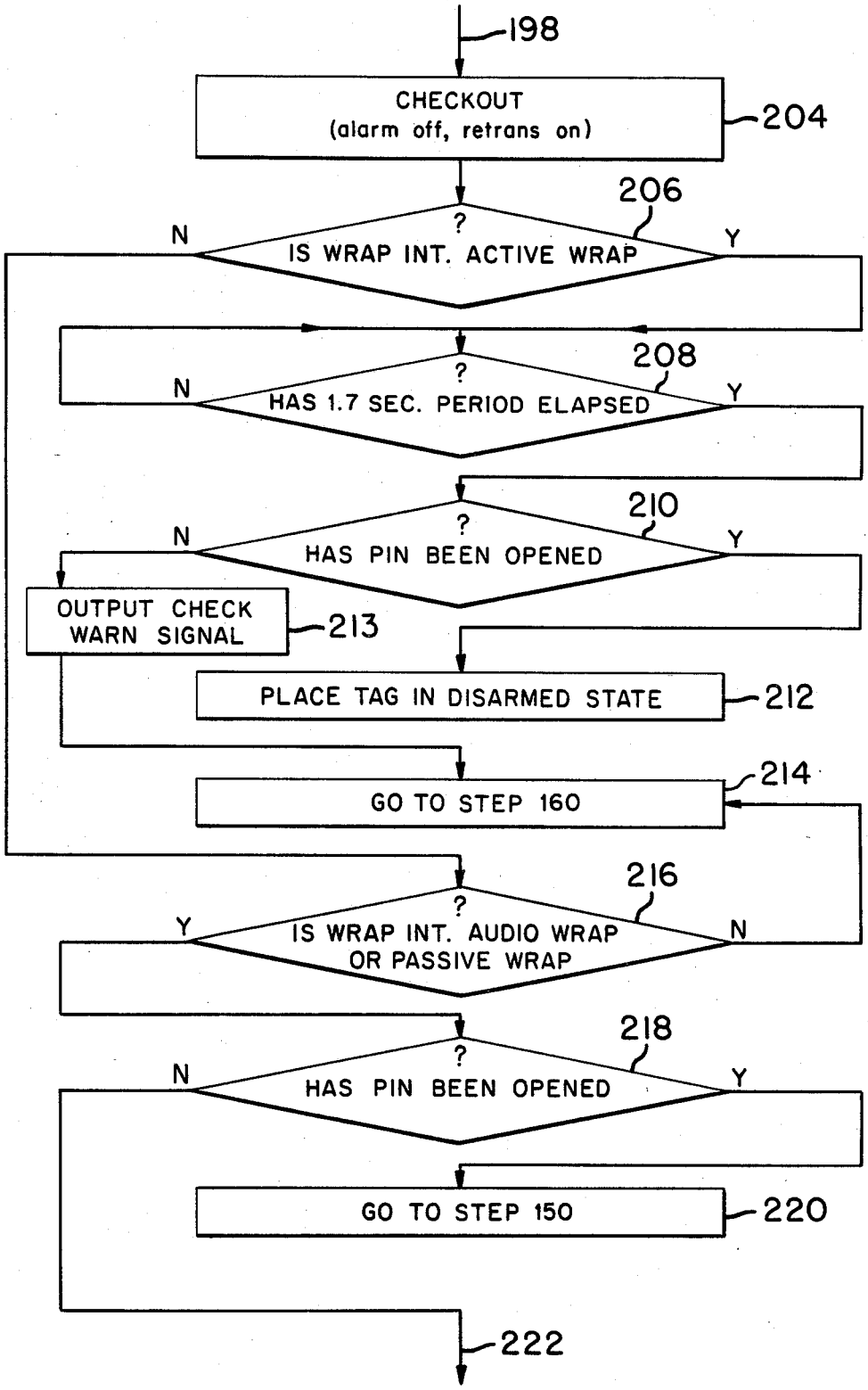
FIGS. 7(*a*), 7(*b*) and 7(*c*) depict the flow chart of the checkout subroutine of the main program implemented by the controller of FIG. 5.
Figure 7B:
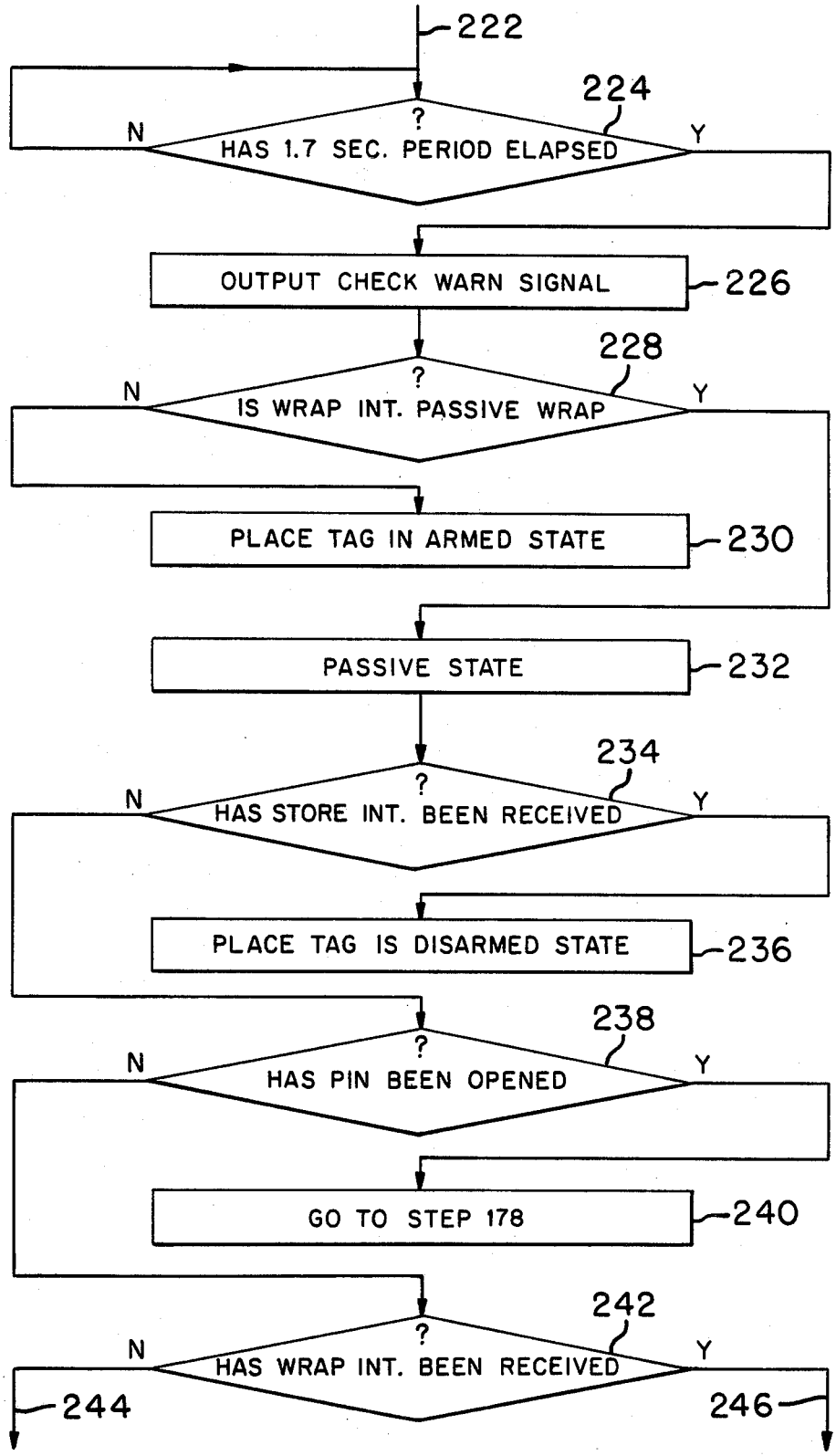
Figure 7C:
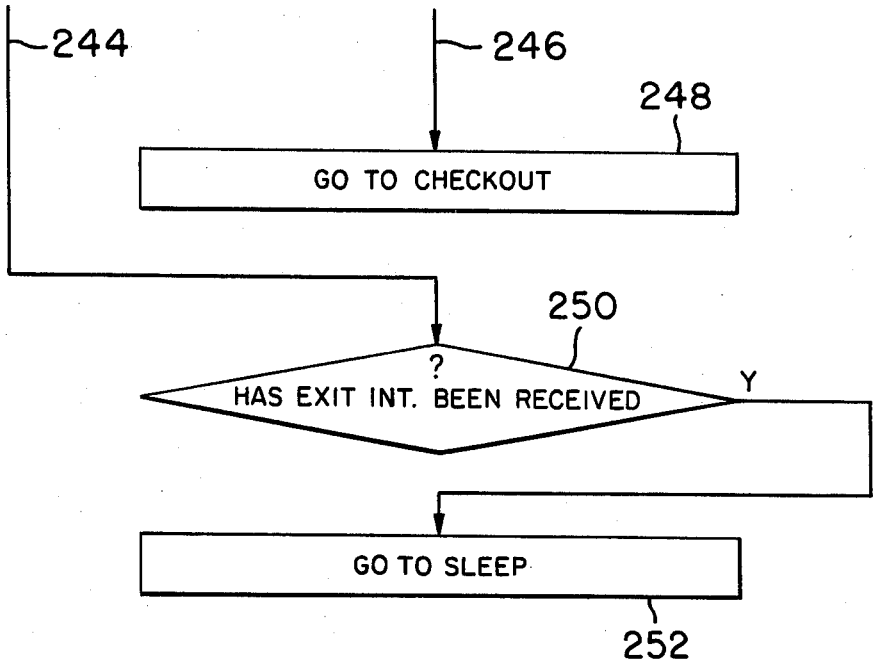

Turning now to the checkout subroutine, same is entered in FIG. 7(*a*) in step 204 - Checkout, wherein the tag alarm is off and its retransmission is on. As noted above, the invention provides user selection as to three diverse checkout modes. Inquiry is made as to the first mode in step 206 - ? Is Wrap Int. Acitve Wrap. Assuming an affirmative reply to this inquiry, advance is to step 208 - ? Has 1.7 Sec. Period Elapsed. This provides a time window of almost two seconds during which a clerk at the checkout desk should open the pin and remove the tag from the article for storage thereof. If the clerk does so, positive reply exists then as to the inquiry of step 210 - ? Has Pin Been Opened, and advance is to step 212 - Place Tag in Disarmed State.

If the inquiry of Step 210 is answered in the negative following the time period of 208, advance is through step 213, Output Check Warn Signal, to step 214 - Goto Step 160, i.e. the tag is returned to Armed state. Upon subsequent receipt of an exit instruction, the tag will alarm and retransmit. Thus this checkout mode adopts the premise that no tag will leave the retail installation.

If the answer to the step 206 inquiry was negative, i.e., that the checkout mode in use was not Active Wrap, practice advances to step 216 - Is Wrap Int. Audio or Passive Wrap. If, for any reason, the answer to this inquiry is negative, the tag is directed to step 160 armed state in step 214. Otherwise, advance is to step 218 - ? Has Pin Been Opened. If the pin has been opened by the clerk, flow is to step 220 - ? Goto Step 150 and the tag is placed in Disarmed state.

If the inquiry of step 218 is answered in the negative, advance is through line 222 into FIG. 7(*b*) and step 224 - ? Has 1.7 Sec. Period Elapsed. Upon expiration of this period, practice is made of step 226 - Output Check Warn Signal.

Steps 216 through 226 are common to both Audio Wrap and Passive Wrap checkout modes. In step 228 - ? Is Wrap Int. Passive Wrap, inquiry is made to distinguish these checkout modes and subsequent handling tags. A negative answer to step 228, indicating that the mode at hand is Audio Wrap, advances practice to step 230 - Place Tag iin Armed State. Accordingly, the above premise common to the Active Wrap mode is adopted also in the Audio Wrap mode, the Audio Wrap mode including also the Check Warn Signal.

If the inquiry of step 228 is answered in the affirmative, flow is to step 232 - Passive State, retransmission on and alarm off. Continuation of the Passive Wrap checkout mode leads to the inquiry of step 234 - ? Has Store Int. Been Received, positive reply to which advances practice to step 236 - Place Tag in Disarmed State. On negative reply to the step 234 inquiry, flow is to step 238 - Has Pin Been Opened, positive answer to which leads to step 240 - Goto Step 178 and output of the theft warn signal. On negative answer to the step 238 inquiry, flow is to the inquiry of step 242 - ? Has Wrap Int. Been Received. Positive answer to the step 242 inquiry advances practice over line 246 to FIG. 7(*c*) and step 248 - Goto Checkout. Negative answer to the inquiry of step 242 leads over line 244 to the inquiry of step 250 - ? Has Exit Int. Been Received. Affirmative reply to this inquiry leads to step 252 - Goto Sleep.

Figure 8:
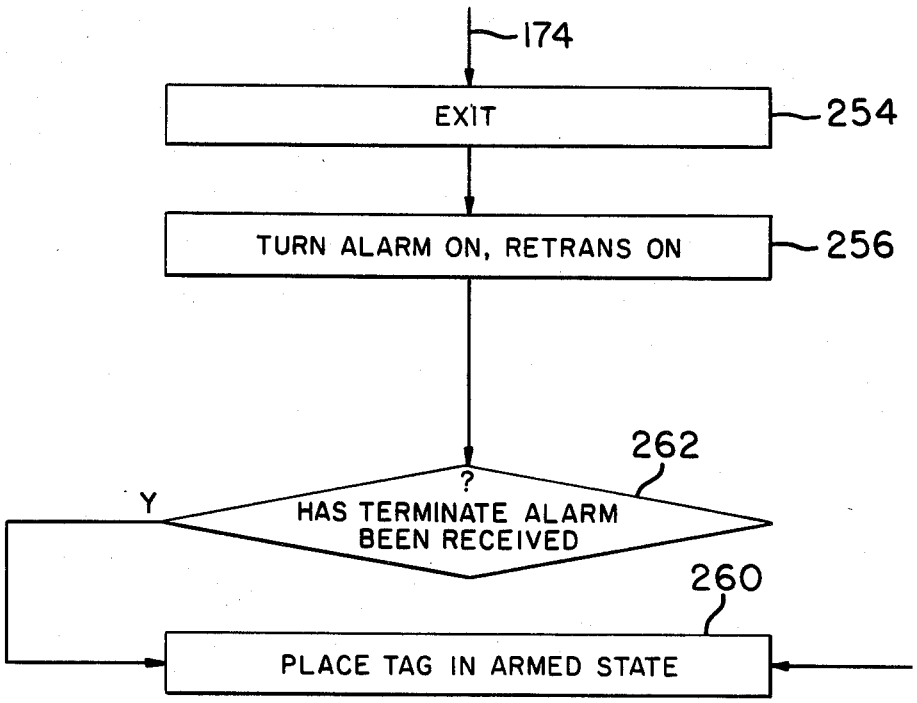
FIG. 8 depicts the flow chart of the fitting subroutine of the main program implemented by the controller of FIG. 5.

The exit subroutine of FIG. 8 is entered in step 254 - Turn Alarm On, Retrans On. This tag condition continues until satisfaction of the inquiry of step 262 - ? Has Terminate Alarm Int. Been Received. On positive response to this inquiry, flow is to step 260 - Place Tag in Armed State.

Figure 9:
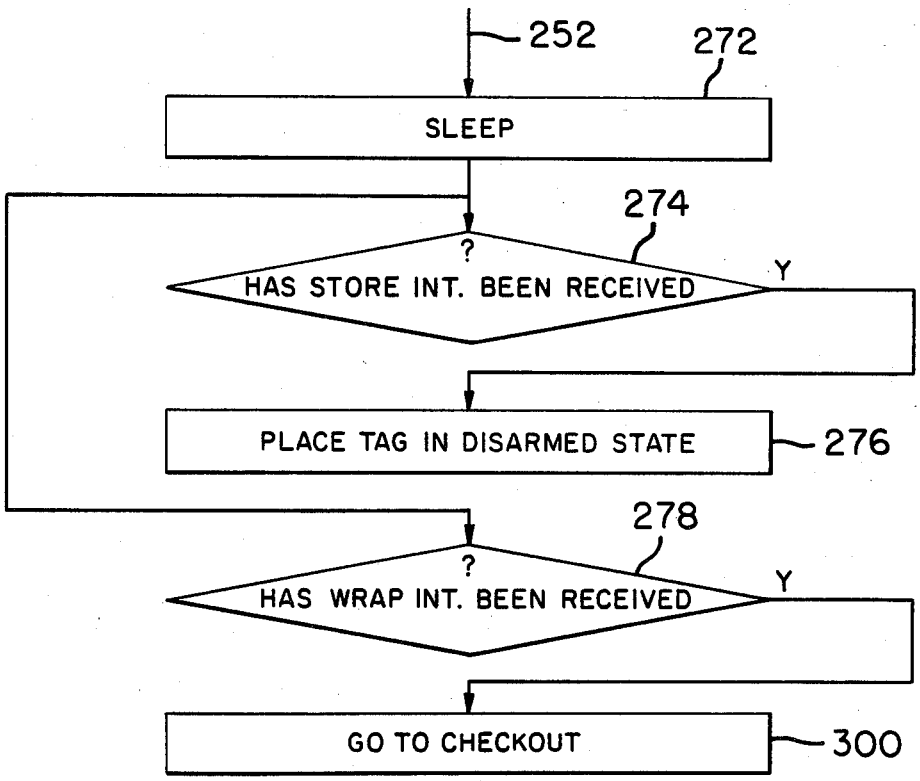
FIG. 9 depicts the flow chart of the sleep subroutine of the checkout subroutine of the main program implemented by the controller of FIG. 5.

Turning now to FIG. 9, the tag sleep subroutine, which flows from the checkout subroutine in the Passive Wrap checkout mode, is entered in step 272 - Sleep. Inquiry is made in step 274 - ? Has Store Int. Been Received, and positive response thereto leads to step 276 - Place Tag In Disarmed State. Inquiry is also made in step 278 - ? Has Wrap Int. Been Received, affirmative response to which leads to step 280 - Goto Checkout.

Figure 10:
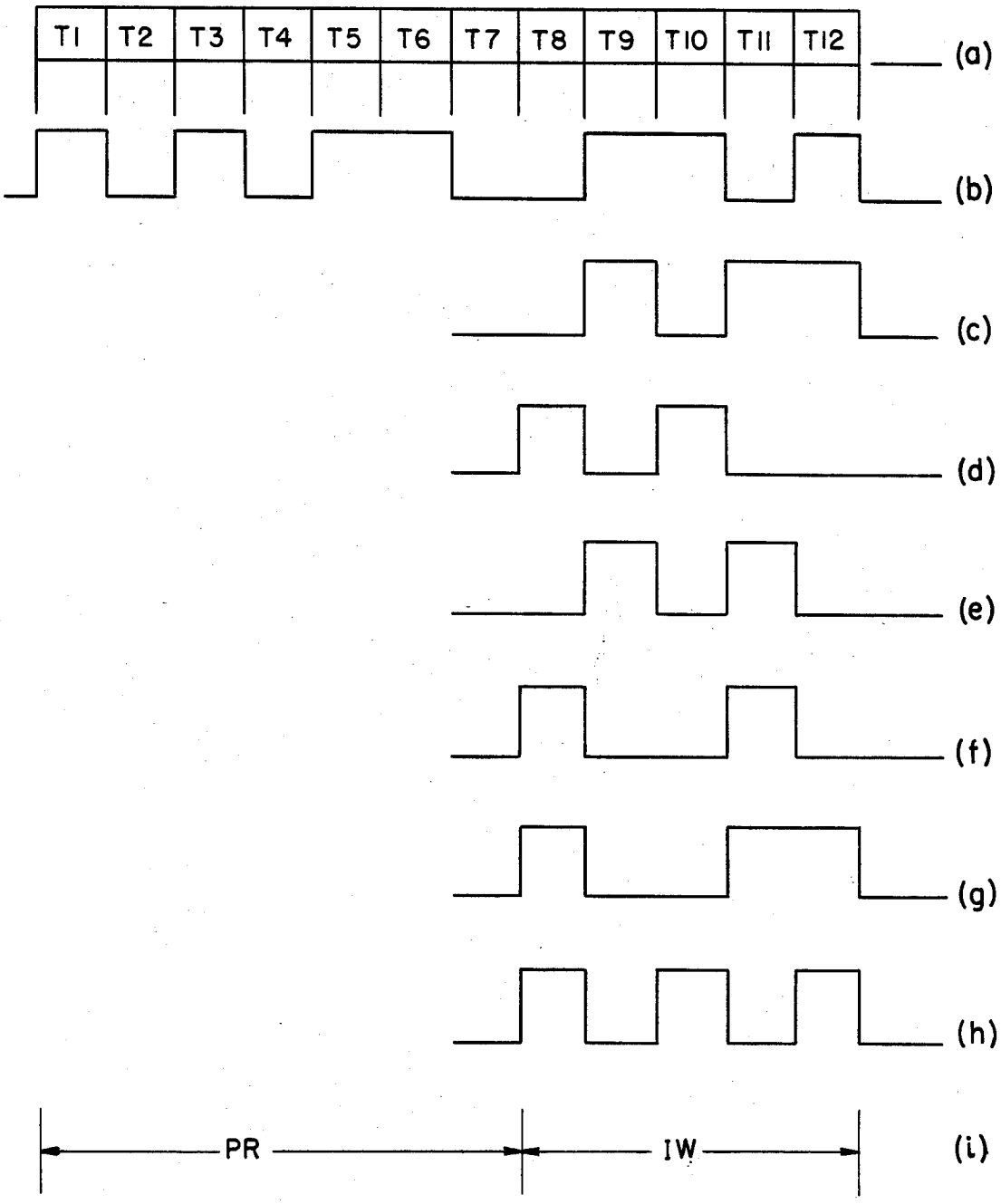
FIG. 10 shows in its subparts the several signal formats involved in the transmissions of the system of the FIG. 1 installation.

FIG. 10(*a*) depicts a twelve slot time scale, T1 through T12, in which each of the twelve slots occupy 4.05 milliseconds, the total time scale being 4.86 milliseconds. In FIG. 10(*b*), there is shown the system signal transmission containing the message for Active Wrap checkout mode, comprising the digital format 101011001101. In each time slot if "1" designation, sixteen cycles of carrier are transmitted, for example, each cycle of 39.5 kilohertz, and in each time slot of "0" designation, carrier is not transmitted. Time slots T1 through T7 are dedicated to the preamble of transmitted signals, i.e., a pattern (1010110) which the receivers of tags must discern prior to considering the message of the transmitted signals. Time slots T8 through T12 comprise five slots in which the various messages or instruction words to be conveyed to tags are defined by permutative use of the time slots. The message pattern for the Active Wrap interrogation or signal is thus 01101 as in FIG. 10(*b*). The message pattern for the Audio Wrap signal is 01011 as in FIG. 10(*c*). The message pattern for the Passive Wrap signal is 10100 as in FIG. 10(*d*). The message pattern for the Exit signal is 01010 as in FIG. 10(*e*). The message pattern for the Storage signal is 10010 is in FIG. 10(*f*). The message pattern for the Terminate Alarm signal is 10011 as in FIG. 10(*g*). The message pattern for the Fitting signal is 10101 as in FIG. 10(*h*). FIG. 10(*i*) indicates the separation as between the preamble PR and the instruction word IW of system transmissions to tags.

Figure 11:
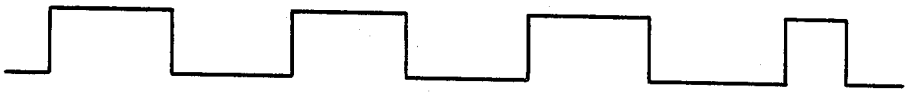
FIGS. 11, 12 and 13 depict diverse alarm driving signals for use in practice of the invention.

As noted above, the invention looks to a variety of audio output signals from its tags. FIG. 11 shows the output alarm indication selected for theft warning, a periodic audio drive signal which may have ON periods, indicated by positive pulses, each of 104 milliseconds, and OFF periods, occurring between successive ON periods, also of 104 milliseconds. Audio output occurs at, for example, 3291 hertz, during ON periods. The rightwardmost pulse in FIG. 11 is shown as foreshortened, as by reason of the occurrence of a Terminate Alarm signal.

Figure 12:
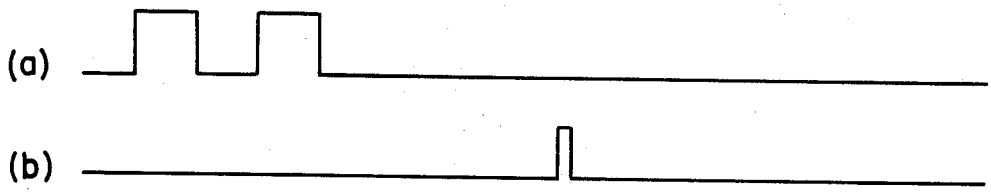

FIG. 12(*a*) depicts a second variant of audio drive signal wherein two beeps will be provided to indicate the Theft Warn condition above discussed. The ON periods are indicated again by positive pulses, each of 104 milliseconds during which audio output at 3291 hertz occurs, and OFF periods are again indicated by the base line. FIG. 12(*b*) shows the Theft Warn complete signal, occurring at some 415 milliseconds after the two audio drive pulses.

Figure 13:
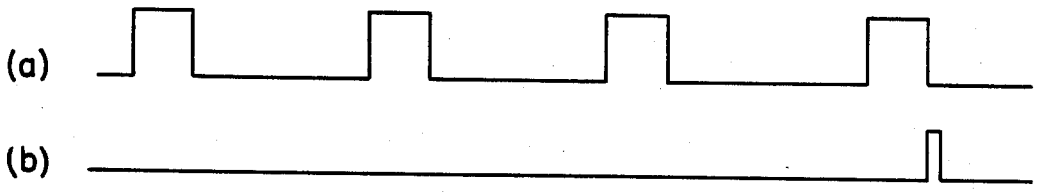

In FIG. 13(*a*) is shown the above-noted Check Warn audio drive signal, comprised of a periodic train of four ON periods indicated by positive pulses, each of 104 milliseconds during which audio output at 3291 hertz occurs, and OFF periods of 726 milliseconds between successive ON period pulses. FIG. 13(*b*) depicts the Check Warn Complete signal, which occurs on completion of the fourth ON period.

Figure 14:
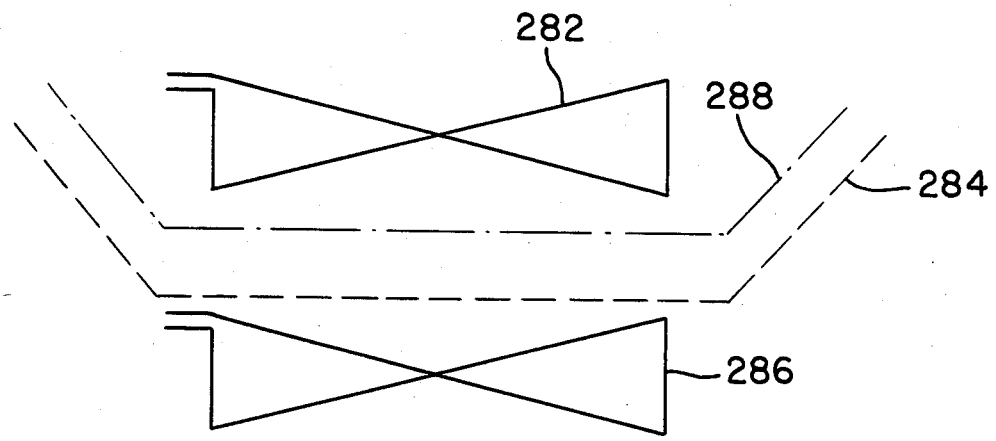
FIG. 14 shows an arrangement of primary and secondary transmitting antennas in accordance with the invention.

Prior to discussion of the antenna arrangement of FIG. 14, it will be helpful to reflect back on the outset introductory remarks with respect to the problems in prior art surveillance systems of type employing radiant energy transmissions to alarm tags. As therein noted, it is evidently desirable to define clear lines of demarcation as between intended article display areas, exit areas and checkout stations. On occasion, the exit and checkout transmissions thus have caused output alarm indication by tags disposed in the article display areas.

FIG. 14 depicts an antenna arrangement which might be disposed centrally in the exit area of the FIG. 1 installation, as contrasted with the sideward exit transmitter units 18*a* and 18*b*, and configured to avoid spurious transmission of the exit interrogation into the checkout area. Primary antenna 282 transmits the exit signal of FIG. 10(*e*), 101011001010, which is repeated in FIG. 15(*a*). The radiation pattern of antenna 282, which may be termed a primary antenna, is shown generally by the boundary line 284, extending into area adjacent the exit which desirably is for use in the checkout function. In accordance with the present invention, a secondary antenna 286 is introduced and is fed with the transmission signal of FIG. 15(*b*), whose digital format is 010100110101, the full complement of the FIG. 15(*a*) signal.

Given the respective complemental transmissions of primary and secondary antennas 282 and 286, a quite definite line of demarcation 288 is defined whereby articles displayed in the zone between line 288 and 284 are protected from spurious alarm indication. Thus, tagged articles in such zone will receive the signal shown in FIG. 15(*c*), which is bereft of both preamble and instruction word intelligence.

Figure 15:
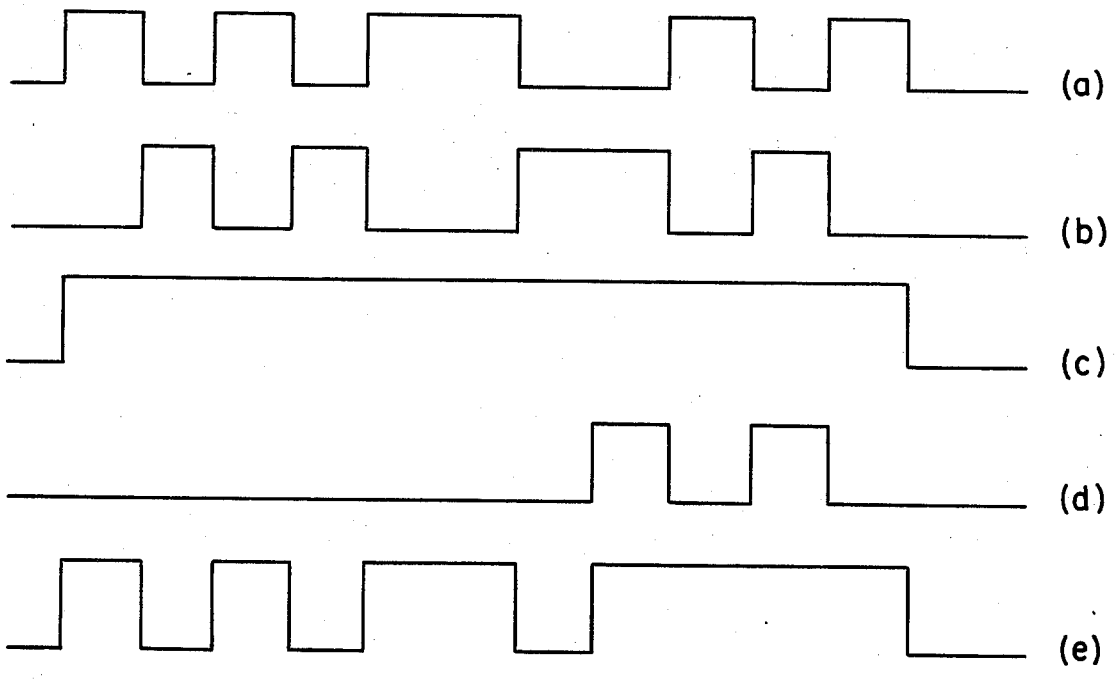
FIG. 15 illustrates various signal formats for the antenna arrangement of FIG. 14.

As is shown in FIG. 15(*d*), the transmission from secondary antenna 286 need not complement the preamble, but only the instruction word of the primary antenna transmission. Here, the secondary antenna transmission is quieted during the preamble portion of the primary antenna transmission and simply complements the instruction word transmission thereof. There results, as in FIG. 15(*e*), the receipt and decoding by tags of the preamble portion of the system transmission, but a meaningless (unused) instruction word (11111).

A further alternative in message transmission in accordance with the invention would employ transmitting antennas positioned opposite one another and transmitting into the space therebetween and behind the antennas. Each antenna transmits one half of the message and is quiet during the transmission of the other. Tags between the antennas receive the total transmitted message, whereas tags not located between the antennas will receive only one-half of the transmitted message and will accordingly be unresponsive.

As will be seen from the foregoing, the invention provides in one aspect an electronic surveillance system of type employing alarm tags releasably attachable to articles to be monitored in an installation, the system comprising: transmitter means for radiating signals containing respective different messages for the tags, a plurality of alarm tags, each having attachment means for releasably attaching the tag to an article and providing output indication of the attachment state thereof, receiver means for receiving such radiated signals and for decoding the message contained therein, and tag controller means connected to the attachment means and to the receiver means for selectively generating an output alarm indication responsively to the attachment means indicated state and such decoded messages.

The installation may include an article checkout area and an exit area, and the transmitter means includes respective checkout and exit area antennas for radiation of signals containing diverse ones of the different messages.

The tag controller means may generate the output alarm indication unconditionally upon receipt of the signal radiated by the exit area antenna. Likewise, the tag controller means may generates the output alarm indication unconditionally upon opening state of the attachment means under consumer acting upon same in the display area. The tag controller means may generate the output alarm indication unconditionally upon opening state of the attachment means and concurrent nonreceipt of the signal radiated by the checkout area antenna.

However, the tag controller means maybe further operable to await the expiration of a predetermined time period following receipt of the signal radiated by the checkout area antenna prior to generating the output alarm indication responsively to the state of the attachment means.

One of the signals radiated by the transmitter means may contain a message indicative of termination of tag output alarm indication, the tag controller means being operable upon receipt of such termination message signal to discontinue output alarm indication.

Another of the signals radiated by the transmitter means may contain a message indicative of storage of the tag in non-alarming condition, the tag controller means being operable upon receipt of such storage message signal to render the tag inoperative to rendr the output alarm indication.

The installation may include a sequestered area (fitting room) for consumer taking of the articles and a receiver for receiving tag transmissions. Upon receiving such retransmission, the fitting receiver forwards such indication, by transmission or hard wiring to a central control station.

The system may further include sensor means for providing output indication of the sensing thereby of the tag output alarm indication. This indication is preferably an electrical signal which may be conveyed to a central monitoring station.

The tag output alarm indication is preferably an audible indication and the sensing means may then comprise a transducer responsive to receipt of such audible indication and generating an electrical output signal in response thereto. As noted, the tag controller means provides plural different such alarm output indications and same are provided selectively in response to opening state of the attachment means and to different one of the radiated signals.

In the preferred embodiments, the tag controller means may further include tag transmitter means for selective radiation of signals upon receipt of interrogate messages.

Finally, primary and secondary antennas may be employed, transmiting full opposed complemental messages, partially opposed complemental messages or respective fractions of messages to define tight lines of demarcation as between different installation areas of interest.

Various changes to the particularly disclosed embodiments and modifications to the described practices may be introduced without departing from the invention. Thus, the preferred embodiments and methods are intended in an illustrative and not in a limiting sense. The true spirit and scope of the invention is set forth in the following claims.

We claim:

1. An electronic surveillance system of type employing alarm tags releasably attachable to articles to be monitored in an installation, said system comprising:

(a) transmitter means for radiating signals containing a plurality of different messages for said tags;

(b) a plurality of alarm tags, each having (1) attachment means for releasably attaching said tag to an article and providing an output indication of the attachment state thereof;

(2) receiver means for receiving such radiated signals and for decoding the messages contained therein; and (3) tag controller means connected to said attachment means and to said receiver means for selectively generating an output alarm indication responsive to said attachment means state output indication and such decoded messages.

2. The invention claimed in claim 1 wherein said installation includes an article checkout area and an exit area, said transmitter means including respective checkout and exit area antennas for radiation of signals containing diverse ones of said different messages.

3. The invention claimed in claim 2 wherein said tag controller means generates said output alarm indication unconditionally upon receipt of said signal radiated by said exit area antenna.

4. The invention claimed in claim 3 wherein said tag controller means generates said output alarm indication unconditionally upon an open state of said attachment means and concurrent nonreceipt of said signal radiated by said checkout area antenna.

5. The invention claimed in claim 4 wherein said tag controller means is further operable to await the expiration of a predetermined time period following receipt of said signal radiated by said checkout area antenna prior to generating said output alarm indication responsive to the state of said attachment means.

6. The invention claimed in claim 1 wherein said tag controller means generates said output alarm indication unconditionally upon an open state of said attachment means.

7. The invention claimed in claim 1 wherein one of said signals radiated by said transmitter means contains a message indicative of termination of tag output alarm indication, said tag controller means being operable upon receipt of such termination message signal to discontinue an output alarm indication.

8. The invention claimed in claim 1 wherein one of said signals radiated by said transmitter means contains a message indicative of storage of said tag in non-alarming condition, said tag controller means being operable upon receipt of such storage message signal to render said tag inoperative to render said output alarm indication.

9. The invention claimed in claim 1 wherein said tag includes audible signal generator means for such generation of said output alarm indication and includes electrical signal transmitter means operable upon tag alarm condition to generate an output, said installation including a sequestered area to which consumers take of said articles, said sequestered area including a receiver for the receipt of said electrical transmitter means output.

10. The invention claimed in claim 1 wherein said system further includes sensor means for providing output indication of the sensing thereby of such tag output alarm indication.

11. The invention claimed in claim 10 wherein said tag output alarm indication is an audible indication, said sensing means comprising a transducer responsive to receipt of said audible indication and generating an electrical output signal in response thereto.

12. The invention claimed in claim 1 wherein said tag controller means provides plural different such alarm output indications.

13. The invention claimed in claim 12 wherein said different alarm output indications are provided selectively in response to opening state of said attachment means and to different ones of said radiated signals.

14. The invention claimed in claim 1 wherein said tag controller means further includes tag transmitter means for radiation of signals selectively in accordance with receipt of certain of said messages.

15. An electronic surveillance system of type employing alarm tags releasably attachable to articles to be monitored in an installation, said system comprising:

(a) primary transmitter means for radiating a signal containing a message for said tags;

(b) a plurality of alarm tags, each having receiver means for receiving such radiated signals and for decoding the message contained therein; and (c) secondary transmitter means for radiating a signal of complemental character to that radiated by said primary transmitter means.

16. The invention claimed in claim 15 wherein said signal radiated by said primary transmitter means comprises a preamble portion and a message portion, said signal radiated by said secondary transmitter means having a preamble portion and a message portion.

17. The invention claimed in claim 16 wherein said preamble portion and said message portion of said signal radiated by said secondary transmitter means are complemental respectively to said preamble portion and said message portion of said signal radiated by said primary transmitter means.

18. The invention claimed in claim 16 wherein said message portion of said signal radiated by said secondary antenna is complemental to said message portion of said signal radiated by said primary transmitter means.

19. The invention claimed in claim 15 wherein said system is disposed in an installation having a first controlled area and an adjacent second controlled area and wherein said message contained in said signal radiated by said first transmitter means is a message intended for receipt and decoding by receiver means of tags disposed exclusively in first controlled area, said first transmitter means being located in said first controlled area and said second transmitter means being located between said primary transmitter means and said second controlled area.

20. The invention claimed in claim 19 wherein said first controlled area is an exit area of said installation and wherein said second controlled area is a checkout area of said installation.

* * * * *